United States Patent [19]

Koga et al.

[11] Patent Number: 4,582,662

[45] Date of Patent: Apr. 15, 1986

[54] PROCESS FOR PRODUCING A CARBON FIBER FROM PITCH MATERIAL

[75] Inventors: Shinichiro Koga, Nougata; Taizo Okajima, Kitakyushu; Shigeya Yamaguchi, Okagaki; Eisaku Kakikura, Kitakyushu, all of Japan

[73] Assignee: Mitsubishi Chemical Industries Ltd., Tokyo, Japan

[21] Appl. No.: 613,070

[22] Filed: May 22, 1984

[30] Foreign Application Priority Data

May 27, 1983 [JP] Japan ..... 58-93823
May 16, 1984 [JP] Japan ..... 59-98416

[51] Int. Cl.[4] ..... D01F 9/14

[52] U.S. Cl. ..... 264/29.2; 264/29.6; 264/29.7; 264/130; 264/131; 264/136; 423/447.4; 423/447.6

[58] Field of Search ..... 264/29.2, 29.6, 29.7, 264/29.1, 130, 131, 136; 423/447.6, 447.4; 427/227

[56] References Cited

U.S. PATENT DOCUMENTS

| | | | |
|---|---|---|---|
| 3,975,482 | 8/1976 | Rulison | 264/29.1 |
| 4,259,307 | 3/1981 | Maruyama | 264/29.2 |
| 4,275,051 | 6/1981 | Barr | 264/29.2 |
| 4,284,615 | 8/1981 | Maruyama | 264/29.2 |
| 4,378,343 | 3/1983 | Sugiura et al. | 264/29.2 |
| 4,496,631 | 1/1985 | Adachi et al. | 264/29.2 |

FOREIGN PATENT DOCUMENTS

| | | | |
|---|---|---|---|
| 0014161 | 8/1980 | European Pat. Off. . | |
| 2071948 | 9/1971 | France . | |
| 49-117724 | 11/1974 | Japan | 423/447.4 |
| 52-34025 | 3/1977 | Japan | 264/29.2 |
| 54-50624 | 4/1979 | Japan | 264/29.2 |
| 54-134126 | 10/1979 | Japan | 264/29.2 |
| 54-131032 | 10/1979 | Japan | 264/29.2 |

OTHER PUBLICATIONS

Japanese Patent Gazette, vol. 82, No. 23, 1982; p. 3; Derwent Publ. Ltd.

*Primary Examiner*—Jeffery Thurlow
*Attorney, Agent, or Firm*—Oblon, Fisher, Spivak, McClelland & Maier

[57] ABSTRACT

A process for producing a carbon fiber from pitch material, which comprises melt spinning pitch material through spinning nozzles to form precursory pitch fibers and oiling the precursory pitch fibers, followed by infusible treatment and carbonization and optionally by graphitization, characterized in that an oiling agent composed essentially of a silicone oil is applied to the precursory pitch fibers prior to or during the oiling operation.

10 Claims, 1 Drawing Figure

PROCESS FOR PRODUCING A CARBON FIBER FROM PITCH MATERIAL

Figure 1:
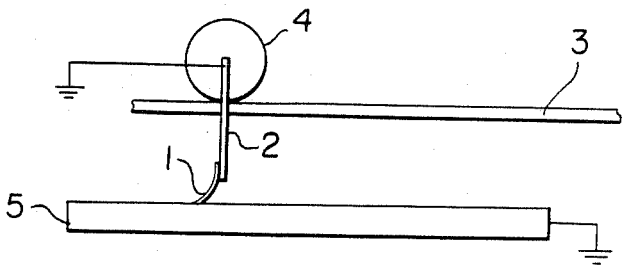

The present invention relates to a process for producing a carbon fiber from pitch material such as a coal-originated pitch, a petroleum pitch or a baked polymer pitch. More particularly, it relates to a process for producing such a pitch-type carbon fiber of high quality which is composed of carbon fiber monofilaments bound together without direct adhesion or fusion to one another, and which is easy to handle and can readily be unbound or separated into individual carbon fiber monofilaments.

Pitch-type carbon fibers are produced usually by melt-spinning the pitch material to form precursory pitch fibers and subjecting the precursory pitch fibers to infusible treatment and carbonization treatment. Such pitch-type carbon fibers have an advantage that they can be produced in good yield and at low costs as compared with carbon fibers made of e.g. polyacrylonitriles. On the other hand, they have a disadvantage that the precursory pitch fibers are extremely brittle and difficult to handle for the infusible treatment or carbonization treatment. The precursory pitch fibers are likely to undergo fluffing, twine round guide rollers or break during such treatments. Further, there are additional difficulties such that adhesion or fusion is likely to take place among the precursory pitch fibers during the infusible treatment and the carbonization treatment, and the resulting carbon fiber surface is susceptible to damages.

These problems are substantially different from the problems involved in the case of the polyacrylonitrile-type carbon fiber which differs from the pitch-type carbon fiber in the starting materials as well as in the manner of the production.

In general, in the case of the polyacrylonitrile-type carbon fiber, the strength of the fibers formed by spinning, is substantially greater than the strength of the precursory pitch fibers. Therefore, there has been no particular difficulty in the handling of the fibers or a tow of such fibers. For example, a polyacrylonitrile-type carbon fiber is produced in the following manner.

A molten polyacrylonitrile is subjected to wet spinning in which it is extruded through spinning nozzles into a spinning bath composed essentially of a mixture of dimethylformamide with water or a mixture of dimethylsulfoxide with water and thereby forms solidified fibers. The formed fibers are wetted with the solution of the spinning bath and bundled into a tow in the spinning bath. The tow withdrawn from the spinning bath is subjected to flame resistant treatment in an oxidizing atmosphere at a temperature of from 200° to 300° C. and then to carbonization treatment in an inert atmosphere at a temperature of from 300° to 1400° C. For such treatments, it is considered effective to apply a lubricant such as polyethylene glycol, polypropylene glycol or an emulsion of water and a silicone oil to the surface of the tow. However, when such a lubricant is used as an oiling agent for the step of oiling precursory pitch fibers, there will be difficulties such that the precursory pitch fibers are thereby partly dissolved, or the fibers tend to adhere or fuse to one another, whereby the tow tends to be stiff or rigid.

Under these circumstances, the present inventors have conducted extensive researches to overcome the difficulties specific to such precursory pitch fibers and to develop a process for producing a carbon fiber having high strength. As a result, they have found that the above-mentioned difficulties may be overcome by applying an oiling agent composed essentially of a silicone oil to precursory pitch fibers prior to or during the oiling operation, and further that the separability of the carbon fiber into monofilaments can be improved by using a suspension comprising a silicone oil and fine solid particles as the oiling agent. The present invention has been accomplished based on these discoveries.

Namely, the present invention provides a process for producing a carbon fiber from pitch material, which comprises melt spinning pitch material through spinning nozzles to form precursory pitch fibers and oiling the precursory pitch fibers, followed by infusible treatment and carbonization and optionally by graphitization, characterized in that an oiling agent composed essentially of a silicone oil is applied to the precursory pitch fibers prior to or during the oiling operation.

FIG. 1 is a diagrammatic illustration of an apparatus used to measure the separability of carbon fiber.

Now, the present invention will be described in detail with reference to the preferred embodiments.

As the pitch material to be used in the present invention, there may be mentioned a coal-originated pitch such as coal tar pitch or liquefied coal; a petroleum pitch such as a distillation residue obtained by the distillation of crude oil under atmospheric or reduced pressure or a heat-treated product thereof, or a heat-treated product of by-product tar obtained by the pyrolysis of naphtha; and a baked polymer pitch obtained by the carbonization of a synthetic or natural resin.

The melt spinning of the pitch material is conducted by extruding it into a gaseous atmosphere through spinning nozzles in the same manner as in the case of the melt spinning of polyester or polyamide fibers. It is preferred to employ a method wherein the pitch material is melted by an extruder or the like and extruded into a gaseous atmosphere from spinning nozzles directed downwardly, whereupon the extruded fibers are cooled and solidified. It is usual to employ spinning nozzles with discharge outlets having a diameter of from 0.1 to 0.3 mm. The temperature of the spinning nozzles is determined depending upon the type of the pitch material to provide a melt viscosity most suitable for spinning, and it is usually selected within a range of from 250° to 350° C. It is effective for the stabilization of spinning to provide temperature-keeping cylinders below the spinning nozzles.

In the present invention, an oiling agent composed essentially of a silicone oil is applied to the precursory pitch fibers obtained by the spinning, prior to or during the oiling operation. As a specific example of such a silicone oil, dimethylpolysiloxane is usually employed. It is also possible to employ modified dimethylpolysiloxane derivatives obtained by introducing various groups to dimethylpolysiloxane. Specifically, there may be mentioned, for example, methylphenylpolysiloxane or hydrodienepolysiloxane. Further, there may be employed other derivatives obtained by modifying dimethylpolysiloxane with one or more groups selected from the group consisting of an epoxy group, an alkyl group such as ethyl or propyl, an amino group, a carboxyl group, an alcohol, a phenyl group or a polyether. These silicone oils may be used alone or in combination as a mixture of at least two different kinds. It is preferred that these silicone oils contain no emulsifier, and they do not contain a substantial amount of water. Namely, non-water-dispersed silicone oils are preferred.

In the present invention, an adequate effect is obtainable even when a silicone oil having the above-mentioned properties is used alone as an oiling agent. However, it is further preferred to employ a suspension comprising a silicone oil and fine solid particles, as an oiling agent, whereby the separability of the resulting carbon fiber into individual carbon monofilaments can be improved over the case where the silicone oil is used alone as the oiling agent. Here, as the fine solid particles, there may be mentioned, for instance, fine carbonaceous particles, fine inorganic oxide particles, fine inorganic salt particles or a mixture thereof. Specifically, there may be mentioned fine particles of graphite, carbon black, silica, calcium carbonate, titanium oxide, talc, clay, barium sulfate, potassium titanate or molybdenum disulfide. Particularly preferred are fine particles of graphite, carbon black, silica, or calcium carbonate.

For adequate penetration into spaces among precursory pitch fibers, these fine particles usually have an average particle size of at most 15 μm, preferably from 0.01 to 5 μm, more preferably from 0.05 to 3 μm. Graphite may be synthetic or natural. Carbon black may be obtained by various methods and includes furnace black, thermal black, lump black and contact black. As silica, there may be employed fine silica particles which are commonly referred to as humed silica or white carbon which is obtainable by a dry method or a wet method of e.g. pyrolysis of a silicone halide or acid decomposition of sodium silicate. As calcium carbonate, there may be employed precipitated fine calcium carbonate, colloidal calcium carbonate or activated calcium carbonate which is obtainable by the mechanical pulverization or chemical precipitation of limestone. As talc, clay, titanium oxide, barium sulfate, potassium titanate and molybdenum disulfide, there may be employed those which are commercially available as fillers for plastics or rubbers and which have the above-mentioned fine particle size. These fine solid particles may be used alone or in combination as an optional mixture to be combined with a silicone oil for the preparation of an oiling agent. The fine solid particles are used usually in a concentration of from 0.1 to 10% by weight, preferably from 1 to 6% by weight in the oiling agent.

The preparation of such an oiling agent is usually conducted by suspensing and mixing predetermined proportions of a silicone oil and fine solid particles by a mixing machine. However, it is also possible to prepare a suspension (i.e. master batch) of a high concentration of fine solid particles in a silicone oil and to dilute the highly concentrated suspension with the silicone oil to the above-mentioned concentration. Further, a suitable dispersant or stabilizer may be added to facilitate the dispersing or to stabilize the suspensed condition. The oiling agent may be applied to the precursory pitch fibers by various methods such as a spraying method, a roller coating method or a dipping method. In any method, it is preferred to apply the oiling agent directly to the fibers. In such a case, if the viscosity is high, its deposition onto the fibers tends to be inferior, and in the subsequent infusible treatment, it hardly evaporates and will be carbonized to form a rough surface, whereby it is hardly possible to obtain a fiber having a smooth surface. Further, if the viscosity is too low, the desired effectiveness will not be obtained. Accordingly, it is usual to employ a silicone oil having a viscosity of from 2 to 10,000 centistokes at 25° C., preferably from 5 to 5,000 centistokes at 25° C.

As an alternative method, the oiling agent may be diluted with a solvent which is incapable of dissolving the precursory pitch fibers, for instance, an ether such as ethyl ether; a ketone such as acetone; a chlorinated hydrocarbon such as trichloroethylene or carbontetrachloride; or an alcohol such as methyl alcohol or ethyl alcohol.

The amount of the deposition of the oiling agent onto the fibers is usually from 0.02 to 10% by weight, preferably from 0.05 to 5.0% by weight. If the amount of the deposition is less than 0.02% by weight, no adequate effectiveness will be obtained. On the other hand, if the amount exceeds 10% by weight, the evaporation at the time of the infusible treatment will be inadequate, and the agent will remain on the filaments and thus hinders the infusible reaction, and a low molecular weight gas generated from the fibers during the infusible treatment will not sufficiently be dissipated, whereby the strength of the carbon fiber will be reduced. The precursory pitch fibers having the oiling agent applied thereon and bundled, are subjected to infusible treatment and carbonization treatment in accordance with known methods. For instance, the infusible treatment may be conducted by heating the tow of fibers at a temperature of from 150° to 360° C. for from 5 minutes to 10 hours in an oxidizing atmosphere such as oxygen, ozone, air, a nitrogen oxide, halogen or sulfur dioxide. The carbonization treatment may be conducted by heating the tow of fibers at a temperature of from 1000° to 2500° C. for from 0.5 minute to 10 hours in an inert gas atmosphere such as nitrogen or argon.

Further, the graphitization may be conducted by heating the tow of fibers at a temperature of from 2500° to 3500° C. for from 1 second to 1 hour.

If necessary, a load or tension may be applied to the tow of fibers to some extent during the infusible treatment, the carbonization treatment or the graphitization treatment for the purpose of preventing shrinkage or deformation.

A carbon fiber or a graphite fiber thus prepared, may be used for various purposes usually after it has been separated or unbound into individual carbon monofilaments.

From the foregoing description, it should be understood that according to the present invention, the handling of brittle fibers can be made easy and it is possible to prevent the adhesion or fusion of the fibers to one another or to prevent the damages to the fiber surface, by a simple operation of applying a oiling agent composed essentially of a silicone oil to the precursory pitch fibers, and it is possible to improve the separability of the resulting carbon fiber into individual carbon monofibers by using an oiling agent comprising a silicone oil and fine solid particles. Thus, a pitch-type carbon fiber having good quality is obtainable in the form of a continuous fiber in an industrially advantageous manner and condition. Further, the heat-treatments can thereby be conducted under uniform and sufficient tension, whereby a pitch-type carbon fiber having superior properties is obtainable at low costs.

Now, the present invention will be described in further detail with reference to Examples. However, it should be understood that the present invention is by no means restricted by these specific Examples.

The separability of the carbon fiber in each of Examples 8 to 14 was determined by the following method.

METHOD FOR MEASURING THE SEPARABILITY OF THE CARBON FIBER

In the accompanying drawing, FIG. 1 illustrates the method for measuring the separability of the carbon fiber into carbon monofilaments.

Referring to FIG. 1, a carbon fiber 1 composed of a plurality of monofilaments was cut into a length of 25 mm. One end of the carbon fiber 1 was secured to an aluminum piece 2 by means of an adhesive, and the other end was cut flush. The aluminum piece 2 having the carbon fiber 1 secured thereto was then fixed to a carrier 4 for reciprocation along an upper rail 3 above a metal plate 5. The aluminum piece 2 was adjusted in its position so that the front end of the carbon fiber 1 was brought in adequate contact with the upper surface of the metal plate 5. The aluminum piece 2 and the metal plate 5 were, respectively, grounded for the prevention of static electricity.

Then, the carrier 4 was reciprocated for 2 minutes under a condition of one cycle per second for a distance of 10 cm. Then, the aluminum piece 2 was detached from the carrier 4, and the carbon fiber 1 was cut to a length of 3 mm from the front end, whereupon the percentage of the monofilaments in the cut carbon fiber was determined by means of a microscope and classified according to the following five rankings.

| Rankings | Percentage (%) of monofilaments* |
|---|---|
| A | 81–100 |
| B | 61–80 |
| C | 41–60 |
| D | 21–40 |
| E | 0–20 |

$$\text{*Percentage (\%) of monofilaments} = \frac{\text{(Number of separated monofilaments)}}{\text{(Total number of monofilaments in the carbon fiber)}} \times 100$$

EXAMPLES 1 to 7

Coal tar-originated pitch material (meso-phase pitch having an optical anisotropy of 95%) was melt-spun into a gaseous atmosphere at a spinneret temperature of 330° C. Then, an oiling agent as identified in Table 1 was applied by means of an oiling guide to the 120 precursory pitch fibers having a diameter of 10 μm thereby obtained, and the fibers were bundled together. The bundled fiber was heated in air from 150° C. to 350° C. over a period of 1 hour to conduct infusible treatment. Then, the fiber was subjected to carbonization treatment by heating it in argon in two steps, i.e. at 1000° C. for 30 minutes and then at 2000° C. for 5 minutes, whereby a carbon fiber was obtained. The state of the twining of fibers, the state of the breakage of monofilaments and the adhesion or fusion of filaments during the process of the production of the carbon fiber, were observed, and the tensile strength of the carbon fiber was measured and the microscopic observation of the carbon fiber was conducted. The results are shown in Table 1.

EXAMPLES 8 to 14

To the same precursory pitch fibers as used in Examples 1 to 7, an oiling agent as identified in Table 2, was applied by means of an oiling guide, and the fibers were bundled. The bundled precursory pitch fiber was subjected to infusible treatment and carbonization treatment under the same conditions as in Examples 1 to 7, whereby a carbon fiber was obtained. The state of the twining of fibers, the state of the breakage of monofilaments and the adhesion or fusion of filaments during the process of the production of the carbon fiber, were observed. Further, the separability of the carbon fiber into individual carbon monofilaments was measured, and the microscopic observation of the carbon fiber was conducted. The results thereby obtained are shown in Table 2.

COMPARATIVE EXAMPLES 1 to 8

The operation was conducted in the same manner as in Examples 1 to 7 except that no oiling agent or an oiling agent other than those of the present invention as identified in Tables 1 and 2, was applied to the same precursory pitch fibers as used in Examples 1 to 7. The results are shown in Tables 1 and 2.

TABLE 1

| | Oiling agents | | | Carbon fibers | | | | |
|---|---|---|---|---|---|---|---|---|
| | Type | Viscosity (centi-stokes) | Deposited amount (% by weight) | Tensile strength (t/cm²) | Adhesion or fusion of fibers | Nature of carbon fiber | Twining round rollers (times/1000 m) | Breakage of mono-filaments (fluffing) |
| EXAMPLE | | | | | | | | |
| 1 | Dimethyl silicone | 50 | 0.05 | 24.5 | No | Flexible | 0 | Minimum |
| 2 | " | 50 | 0.1 | 23.7 | " | " | 0 | " |
| 3 | " | 50 | 1.0 | 23.6 | " | " | 0 | " |
| 4 | " | 50 | 5.0 | 24.3 | " | " | 0 | " |
| 5 | " | 10 | 0.5 | 24.8 | " | " | 0 | " |
| 6 | " | 100 | 0.5 | 23.9 | " | " | 0 | " |
| 7 | " | 200 | 0.5 | 23.6 | " | " | 0 | " |
| COMPARATIVE EXAMPLE | | | | | | | | |
| 1 | None | — | — | 24.3 | " | " | 15 | Great |
| 2 | Polyethylene glycol | — | 1.0 | 13.2 | Yes | Rigid | 4 | Small |
| 3 | Water | — | 1.0 | 19.5 | " | " | 5 | " |
| 4 | Polypropylene glycol | — | 1.0 | 13.0 | " | " | 4 | " |
| 5 | Glycerol | — | 1.0 | 15.1 | " | " | 4 | " |
| 6 | Stearyl alcohol phosphate | — | 1.0 | Not measur-able | " | Hardened and inferior strength | 5 | " |
| 7 | Stearyl alcohol phosphate (95%) Di(nonylphenyl)dinonyl- | | 1.0 | Not measur-able | " | Hardened and inferior strength | 5 | " |

TABLE 1-continued

| Oiling agents | | | | Carbon fibers | | | | |
|---|---|---|---|---|---|---|---|---|
| Type | Viscosity (centi-stokes) | Deposited amount (% by weight) | Tensile strength (t/cm$^2$) | Adhesion or fusion of fibers | Nature of carbon fiber | Twining round rollers (times/1000 m) | Breakage of mono-filaments (fluffing) |
| phenyl phosphite (5%) | | | | | | | |

TABLE 2

| | Bundling agents | | | | | |
|---|---|---|---|---|---|---|
| | Silicone oil | | Fine solid particles | | | |
| | Type | Viscosity (centi-stokes) | Type | Particle size (μm) | Concen-tration % by weight) | Deposited amount % by weight) |
| EXAMPLE | | | | | | |
| 8 | Dimethyl silicone | 50 | Graphite | 1 | 3 | 1 |
| 9 | " | 50 | " | 1 | 3 | 3 |
| 10 | " | 50 | " | 1 | 3 | 5 |
| 11 | " | 10 | " | 1 | 6 | 2 |
| 12 | " | 10 | Carbon black | 0.05 | 5 | 3 |
| 13 | " | 50 | Carbon black | 0.05 | 5 | 1.5 |
| 14 | " | 50 | Silica | 0.05 | 5 | 2.5 |
| Comparative Example | | | | | | |
| 8 | Polyethylene glycol | — | Graphite | 1 | 5 | 4 |

| | Carbon fibers | | | | Twining round rollers (times/1000 m) | Breakage of mono-filaments (fluffing) |
|---|---|---|---|---|---|---|
| | Tensile strength (t/cm$^2$) | Adhesion or fusion of filaments | Properties | Separability into fila-ments | | |
| EXAMPLE | | | | | | |
| 8 | 22.3 | No | Flexible | B | 0 | Minimum |
| 9 | 21.6 | " | " | A | 0 | " |
| 10 | 21.2 | " | " | " | 0 | " |
| 11 | 21.0 | " | " | " | 0 | " |
| 12 | 21.1 | " | " | " | 0 | " |
| 13 | 21.5 | " | " | " | 0 | " |
| 14 | 21.3 | " | " | " | 0 | " |
| Comparative Example | | | | | | |
| 8 | 11.9 | Yes | Rigid | C | 4 | Small |

We claim:

1. A process for producing a carbon fiber from pitch material, which comprises:

melt-spinning pitch material through spinning nozzles thereby forming precursor pitch fibers;

gathering the precursor pitch fibers into a tow, said pitch fibers having applied thereto an oiling agent composed essentially of a silicone-oil prior to or during the gathering operation;

infusiblizing the gathered pitch fibers; and carbonizing or graphitizing the gathered fibers.

2. The process according to claim 1, wherein the oiling agent is a suspension comprising a silicone oil and fine solid particles.

3. The process according to claim 1, wherein the silicone oil is a non-water-dispersed silicone oil.

4. The process according to claim 1, wherein the silicone oil has a viscosity of from 2 to 10,000 centistokes at 25° C.

5. The process according to claim 2, wherein the fine solid particles are fine carbonaceous particles, fine inorganic oxide particles, fine inorganic salt particles or a mixture thereof.

6. The process according to claim 2, wherein the fine solid particles are made of graphite, carbon black, silica, calcium carbonate or a mixture thereof.

7. The process according to claim 2, wherein the fine solid particles have an average particle size of at most 15 μm.

8. The process according to claim 2, wherein the concentration of the fine solid particles in the oiling agent is from 0.1 to 10% by weight.

9. The process according to claim 1, wherein the oiling agent is applied in an amount of from 0.02 to 10% by weight relative to the precursor pitch fibers.

10. A process for producing a carbon fiber from pitch material, which comprises:

melt-spinning pitch material through spinning nozzles to form precursor pitch fibers; gathering the precursor pitch fibers into a tow, said pitch fibers having applied thereto an oiling agent comprising a suspension of a non-water dispersed silicone oil and at least one kind of fine solid particle material having an average particle size of at most 15 μm, said particle material being selected from the group consisting of fine particles of graphite, carbon black, silica and calcium carbonate, said silicone oil being applied to the precursor pitch fibers prior to or during the gathering operation in an amount of from 0.02 to 10% by weight relative to the precursor pitch fibers, the concentration of the fine solid particles in the oiling agent being from 0.1 to 10% by weight;

infusiblizing the gathered pitch fibers; and carbonizing or graphitizing the gathered fibers.

* * * * *